US010872571B2

(12) United States Patent
Noh et al.

(10) Patent No.: US 10,872,571 B2
(45) Date of Patent: Dec. 22, 2020

(54) DISPLAY DEVICE

(71) Applicant: Samsung Display Co., Ltd., Yongin-Si (KR)

(72) Inventors: Dae-hyun Noh, Hwaseong-si (KR); Yongsung Park, Seoul (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 206 days.

(21) Appl. No.: 16/047,135

(22) Filed: Jul. 27, 2018

(65) Prior Publication Data

US 2019/0156760 A1 May 23, 2019

(30) Foreign Application Priority Data

Nov. 22, 2017 (KR) ..... 10-2017-0156121

(51) Int. Cl.
*G09G 3/3266* (2016.01)
*G09G 3/3233* (2016.01)

(52) U.S. Cl.
CPC ..... *G09G 3/3266* (2013.01); *G09G 3/3233* (2013.01); *G09G 2300/02* (2013.01); *G09G 2300/043* (2013.01); *G09G 2300/0426* (2013.01); *G09G 2300/0842* (2013.01); *G09G 2320/0233* (2013.01)

(58) Field of Classification Search
CPC ..... G09G 3/3266; G09G 3/3233
USPC ..... 345/214
See application file for complete search history.

(56) References Cited

U.S. PATENT DOCUMENTS

2014/0160694 A1* 6/2014 Yoon ..... G02F 1/1303 361/749
2016/0377936 A1* 12/2016 Kim ..... G02F 1/139 349/33
2017/0031643 A1* 2/2017 Jeong ..... G06F 3/1446
2017/0185192 A1* 6/2017 Kim ..... G02F 1/1345
2017/0185193 A1* 6/2017 Kim ..... H01L 27/323
2017/0210993 A1* 7/2017 Lim ..... C09K 19/3475

FOREIGN PATENT DOCUMENTS

KR 100692861 B1 3/2007
KR 1020170077917 A 7/2017

* cited by examiner

*Primary Examiner* — Fred Tzeng
(74) *Attorney, Agent, or Firm* — Cantor Colburn LLP

(57) ABSTRACT

A display device includes a base layer a base layer in which a display area and a non-display area adjacent to the display area are defined, the display area including a first display area and a second display area, a plurality of pixels disposed in the display area, a scan driving circuit which is disposed in the non-display area, receives a reference voltage from an outside, and outputs a scan signal to the pixels, a first compensation electrode which is disposed in the non-display area and receives the reference voltage, and a first compensation wiring electrically connected to pixels disposed in the second display area among the plurality of pixels, and extending to the non-display area and overlapping the first compensation electrode in a plan view.

19 Claims, 7 Drawing Sheets

DISPLAY DEVICE

This application claims priority to Korean Patent Application No. 10-2017-0156121, filed on Nov. 22, 2017, and all the benefits accruing therefrom under 35 U.S.C. § 119, the content of which in its entirety is herein incorporated by reference.

BACKGROUND

1. Field

Exemplary embodiments of the invention herein relate to a display device with improved reliability.

2. Description of the Related Art

A display panel includes a display area for displaying an image in accordance with an electrical signal. The display area of the display panel may have not only a typical shape of a tetragon or circle, but also an atypical shape. Accordingly, the image may be displayed in an active area having various shapes and areas through various wiring designs.

SUMMARY

A display panel having an atypical shape compared to a display panel having a typical tetragonal shape may have different luminance depending on an area.

Exemplary embodiments of the invention provide a display device in which luminance of an image displayed on a display panel having an atypical shape is uniformly controlled, and image quality and reliability thereof are improved.

An exemplary embodiment of the invention provides a display device including a base layer in which a display area and a non-display area adjacent to the display area are defined, the display area including a first display area and a second display area protruding from the first display area in a first direction, a plurality of pixels disposed in the display area, a scan driving circuit which is disposed in the non-display area, receives a reference voltage from an outside, and outputs a scan signal to the pixels, a first compensation electrode which is disposed in the non-receiving area, and receives the reference voltage, and a first compensation wiring electrically connected to pixels disposed in the second display area among the plurality of pixels, and extending to the non-display area to overlap the first compensation electrode in a plan view.

In an exemplary embodiment, a width of the first display area in a second direction crossing the first direction may be larger than a maximum width of the second display area in the second direction.

In an exemplary embodiment, the display area may further include a third display area protruding from the first display area in the first direction and spaced apart from the second display area in the second direction crossing the first direction.

In an exemplary embodiment, the display device may further include a second compensation electrode which is disposed in the non-display area, and receives the reference voltage, and a second compensation wiring electrically connected to pixels disposed in the third display area among the plurality of pixels, and extending to the non-display area and overlapping the second compensation electrode in the plan view.

In an exemplary embodiment, the second display area may include a first sub-display area adjacent to the first display area and a second sub-display area spaced apart from the first display area with the first sub-display area in-between and the third display area may include a third sub-display area adjacent to the first display area and a fourth sub-display area spaced apart from the first display area with the third sub-display area in-between, and the display device may further include a second compensation electrode which receives the reference voltage in the non-display area disposed between the first display area and the third display area in the plan view.

In an exemplary embodiment, the display device may further include a second compensation wiring electrically connected to pixels disposed in the first sub-display area and the third sub-display area, and extending to the non-display area and overlapping the second compensation electrode in the plan view.

In an exemplary embodiment, the display device may further include compensation patterns overlapping the first compensation electrode and the first compensation wiring in the plan view, where the first compensation wiring may be disposed between the first compensation electrode and the compensation patterns in a cross section.

In an exemplary embodiment, the compensation patterns may be electrically connected with the first compensation electrode and may receive the reference voltage.

In an exemplary embodiment, when the first compensation wiring overlapping the first compensation electrode extends along a predetermined direction, the compensation patterns may be disposed apart from each other in the same direction as the direction to which the first compensation wiring extends.

In an exemplary embodiment, the pixels may include a thin film transistor including a semiconductor pattern and a light emitting device connected to the thin film transistor, and the compensation patterns may include the same material as that of the semiconductor pattern.

In an exemplary embodiment, a width of the second display area in the second direction crossing the first direction may have a narrowed shape as being farther from the first display area, and the second display area may include a first sub-display area adjacent to the first display area and a second sub-display area spaced apart from the first display area with the first display area in-between.

In an exemplary embodiment, a first number of compensation patterns overlapping a compensation wiring electrically connected to pixels disposed in the first sub-display area among the pixels may be smaller than a second number of compensation patterns overlapping a compensation wiring electrically connected to pixels disposed in the second sub-display area among the pixels.

An exemplary embodiment of the invention provides a display device which may include a base layer in which a display area and a non-display area are defined, a first pixel group and a second pixel group disposed in the display area and arranged along a first direction, a compensation electrode which is disposed in the non-display area and receives a gate-on voltage or a gate-off voltage from an outside, and a compensation wiring electrically connected with pixels of the second pixel group and extending to the non-display area and overlapping the compensation electrode in a plan view, where the first pixel group may include a plurality of first pixels arranged in a second direction crossing the first direction and the second pixel group may include second pixels arranged in the second direction, and a first number of second pixels may be smaller than a second number of first pixels.

In an exemplary embodiment, the display area may include a first display area and a second display area protruding in the first direction from the first display area, and the first pixel group may be disposed in the first display area and the second pixel group may be disposed in the second display area.

In an exemplary embodiment, a width of the first display area in the second direction may be larger than a width of the second display area in the second direction.

In an exemplary embodiment, the first pixel group and the second pixel group may receive a first power supply voltage and a second power supply voltage from the outside.

In an exemplary embodiment, the display device may further include a scan driving circuit which is disposed in the non-display area and receives the gate-on voltage and the gate-off voltage, and outputting a scan signal to the first and second pixel groups.

An exemplary embodiment of the invention provides a display device which may include a base layer in which a display area and a non-display area adjacent to the display area are defined, the display area including a first display area and a second display area protruding from the first display area in a first direction, a plurality of pixels which is disposed in the display area, and receives a first power supply voltage and a second power supply voltage from an outside, a compensation electrode which is disposed in the non-display area, and receives a reference voltage different from the first power supply voltage and the second power supply voltage, and a compensation wiring electrically connected to pixels disposed in the second display area among the plurality of pixels, and extending to the non-display area and overlapping the compensation electrode.

In an exemplary embodiment, a first number of pixels in one row arranged in a second direction crossing the first direction in the first display area may be larger than a second number of pixels in one row arranged in the second direction in the second display area.

In an exemplary embodiment, the display device may further include a scan driving circuit which is disposed in the non-display area, receives the reference voltage, and outputs a scan signal to the plurality of pixels.

BRIEF DESCRIPTION OF THE DRAWINGS

The accompanying drawings are included to provide a further understanding of the invention, and are incorporated in and constitute a part of this specification. The drawings illustrate exemplary embodiments of the invention and, together with the description, serve to explain principles of the invention. In the drawings.

DETAILED DESCRIPTION

Figure 1:
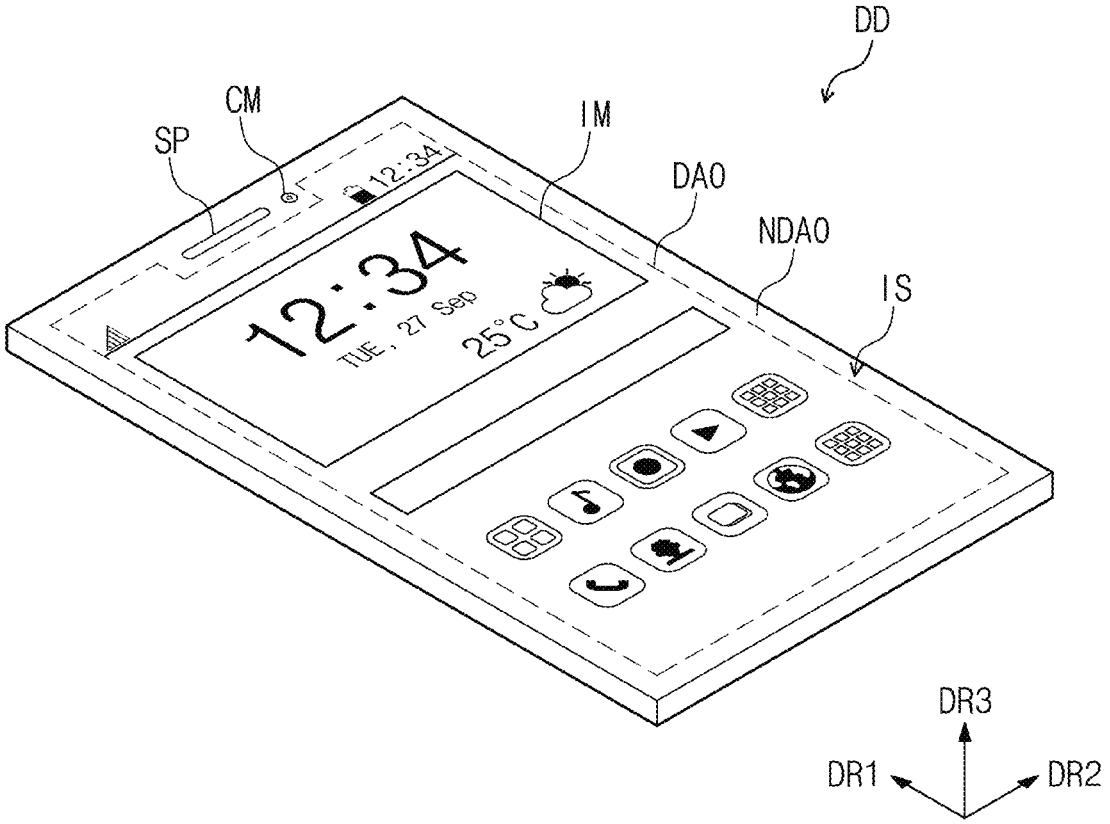
FIG. 1 is a perspective view of an exemplary embodiment of a display device according to the invention.

Hereinafter, embodiments of the invention will be described with reference to the drawings. In the specification, when an element (or area, layer, portion, etc.) is referred to as being "on", "connected to", or "coupled to" another element, it may be directly connected/coupled onto another element or a third element may be disposed therebetween.

Like reference numerals refer to like elements. Also, in the drawings, thickness, ratio, and dimensions of elements are exaggerated for an effective explanation of the technical content. "and/or" includes all combinations of one or more of which the associated configurations can define.

Although the terms first, second, etc. may be used herein to describe various elements, these elements should not be limited by these terms. These terms are only used to distinguish one element from another element. For example, without departing from the teachings of the present invention, a first element could be termed a second element, and similarly, a second element could also be termed a first element. The singular forms are intended to include the plural forms as well, unless the context clearly indicates otherwise.

Furthermore, terms such as "below", "on the lower side", "above", "on the upper side" and the like are used to describe the relationship of the configurations shown in the drawings. The terms are described relative to the direction shown in the figure, in a relative concept.

It will be understood that the terms "includes" and/or "including", when used in this specification, specify the presence of stated features, integers, steps, operations, elements, and/or elements, but do not preclude the presence or addition of one or more other features, integers, steps, operations, elements, elements, and/or groups thereof.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. In an exemplary embodiment, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

FIG. 1 is a perspective view of a display device, according to an exemplary embodiment of the invention.

Referring to FIG. 1, the display device DD may display an image IM through a display surface IS. The display surface IS may be the outermost surface of the display device DD, and may be a surface that the user views.

In FIG. 1, a clock and application icons are illustrated as an example of the image IM. FIG. 1 is a view exemplarily illustrating that the display surface IS has a surface defined by a first direction DR1 and a second direction DR2 crossing the first direction. However, in another exemplary embodiment of the invention, the display surface (not illustrated) of the display device (not illustrated) may have a curved shape.

The normal direction of the display surface IS, that is, the thickness direction of the display device DD is indicated by a third direction DR3. The directions indicated by the first to third directions DR1, DR2 and DR3 are relative concepts and thus may be converted into different directions. Hereinafter, the first to third directions refer to the same reference numerals in the directions indicated by the first to third directions DR1, DR2 and DR3, respectively.

FIG. 1 is a view exemplarily illustrating that the display device DD is a portable electronic apparatus. However, the display device DD may be used not only for a large electronic apparatus such as a television set, a monitor, or an external billboard, but also for a small/medium electronic apparatus such as a personal computer, a notebook computer, a personal digital terminal, a car navigation unit, a game player, a smart phone, a tablet, and a camera. Also, these are merely examples, and may be, of course, adapted to another electronic apparatus as long as not being deviated from the conceptual scope of the invention.

The display surface IS includes a display area DA0 which displays the image IM and a non-display area NDA0 adjacent to the display area DA0. The non-display area NDA0 is an area which does not display an image. The display area DA0 may have an atypical shape. In an exemplary embodiment, the display area DA0 may have a shape in which at least one side having a tetragonal shape protrudes, for example. Details will be described later.

The non-display area NDA0 may surround the display area DA0, but the invention is not limited thereto. The shape of the display area DA0 and the non-display area NDA0 may be designed relatively.

The display device DD may include a speaker SP and a camera module CM. The speaker SP and the camera module CM are disposed so as to overlap the non-display area NDA0, and do not overlap the display area DA0.

Figure 2:
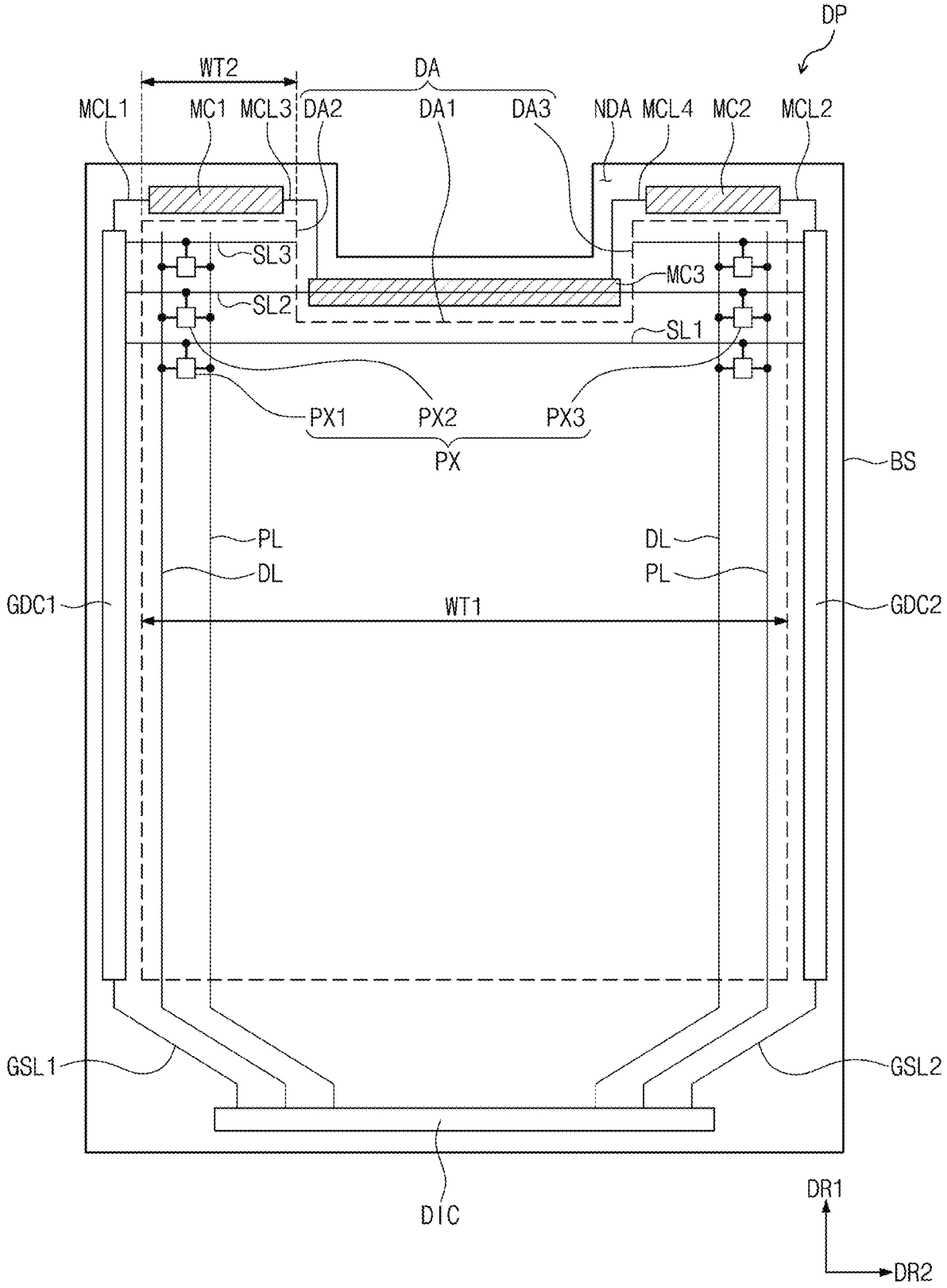
FIG. 2 is a plan view illustrating a portion of the configuration of the display device in FIG. 1.
Figure 3:
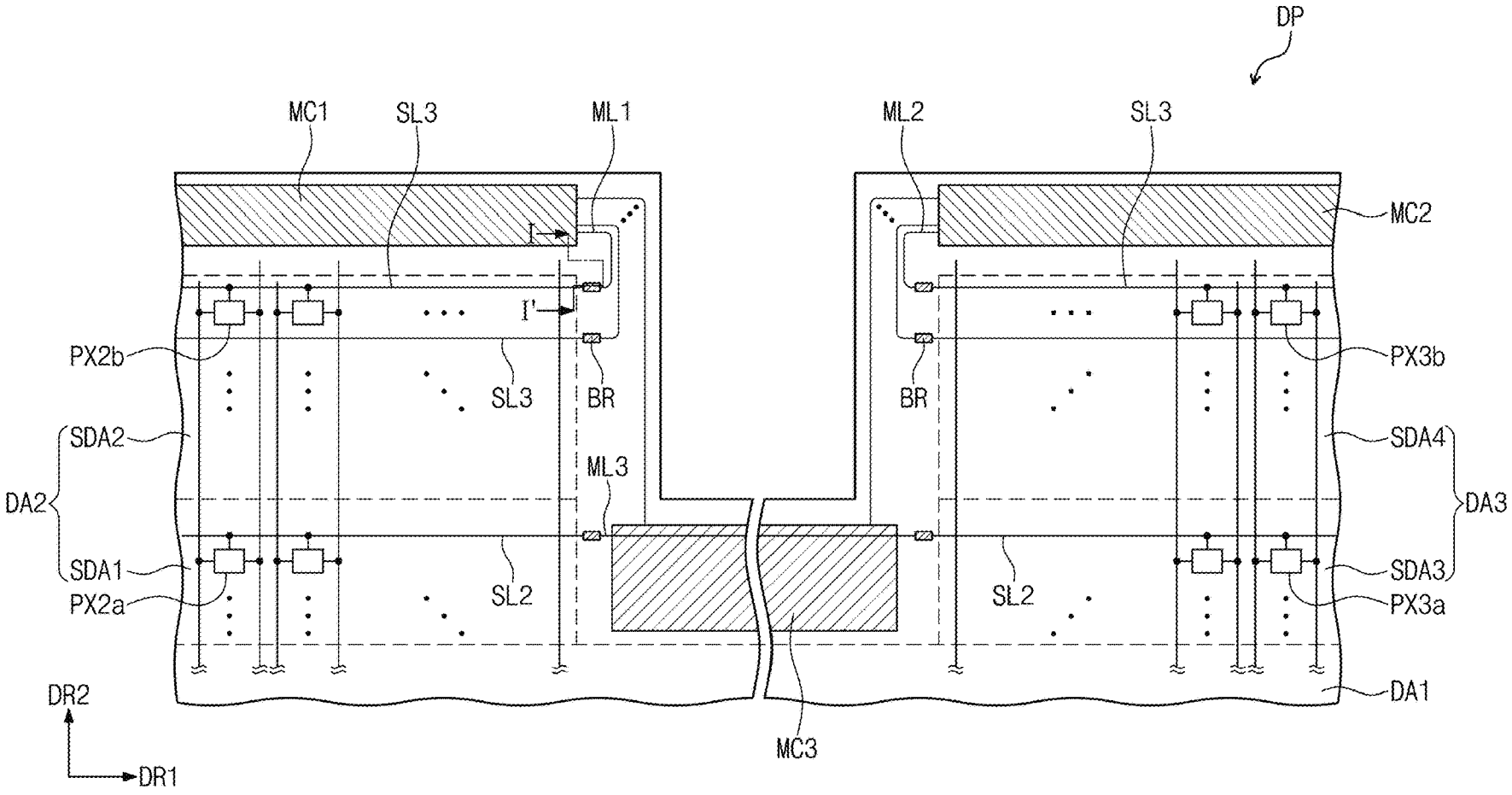
FIG. 3 is an enlarged plan view illustrating a portion of FIG. 2.

FIG. 2 is a plan view illustrating a portion of the configuration of the display area in FIG. 1, and FIG. 3 is an enlarged plan view illustrating a portion of FIG. 2.

Referring to FIGS. 2 and 3, the display device DD (refer to FIG. 1) includes a display panel DP and a driving circuit chip DIC.

The display panel DP may be, but not particularly limited to, a light emitting display panel. In an exemplary embodiment, the display panel DP may be an organic light emitting display panel or a quantum dot light emitting display panel, for example. A light emitting layer of the organic light emitting display panel includes an organic light emitting material. A light emitting layer of the quantum dot light emitting display panel includes a quantum dot and a quantum rod. Hereinafter, the display panel DP is described as an example of the organic light emitting display panel.

The display panel DP may include a base layer BS, a plurality of pixels PX, scan driving circuits GDC1 and GDC2, signal lines, compensation electrodes MC1, MC2 and MC3, and compensation wirings ML1, ML2 and ML3.

In the base layer BS, the display area DA and the non-display area NDA adjacent to the display area DA may be defined in a plan view. The display panel DP may display an image in the area overlapping the display area DA, and may not display an image in the area overlapping the non-display area NDA.

The display area DA and the non-display area NDA illustrated in FIG. 2 correspond to the display area DA0 and the non-display area NDA0 illustrated in FIG. 1, respectively. However, the display area DA and the non-display area NDA of the base layer BS are not need to be necessarily the same as the display area DA0 and the non-display area NDA0 of the display device DD (refer to FIG. 1), and may be changed depending on the structure/design of the display panel DP.

The display area DA may include a first display area DA1, a second display area DA2 and a third display area DA3. The first display area DA1 may have a tetragonal shape in a plan view. The second display area DA2 and the third display area DA3 may protrude from the first display area DA1 in the first direction DR1. The first display area DA1 may be referred as a normal display area, and the second and third areas DA2 and DA3 may be referred as a notch display area.

The number of display areas protruding from the first display area DA1 is not limited, but it is exemplarily illustrated that two protruding display areas (e.g., second and third display areas DA2 and DA3) are provided in examples of the invention. The camera module CM and the speaker SP described with reference to FIG. 1 may be disposed in an area between the second display area DA2 and the third display area DA3.

The second area DA2 may protrude from one side corner of the first display area DA1 in the first direction DR1, and the third display area DA3 may protrude from one side corner of the first display area DA1 in the first direction DR1. The second display area DA2 and the third display area DA3 may be spaced apart from each other in the second direction DR2.

The plurality of pixels PX may be disposed in the display area DA to display an image. The pixels PX may arranged in a matrix form, or in a non-matrix form such as a pentile form.

The pixels PX may include a first pixel PX1 disposed in the first display area DA1, a second pixel PX2 disposed in the second display area DA2, and a third pixel PX3 disposed in the third display area DA3. The first to third pixels PX1, PX2 and PX3 may be provided in plural.

A width WT1 of the first display area DA1 in the second direction DR2 crossing the first direction DR1 may be larger than a maximum width WT2 of the second display area DA2 in the second direction DR2. Thus, the number of first pixels PX1 arranged in the second direction DR2 may be larger than the number of second pixels PX2 arranged in the second direction DR2.

The number of first pixels PX1 arranged in the second direction DR2 and the number of second pixels PX2 arranged in the second direction DR2 mean the number of pixels in one row, respectively. All the first pixels PX1 arranged in one same row may be referred as a first pixel group, and all the second pixels PX2 arranged in one same row may be referred as a second pixel group. The first pixel group and the second pixel group may be arranged along the first direction DR1.

The second display area DA2 may include a first sub-display area SDA1 and a second sub-display area SDA2, and the third display area DA3 may include a third sub-display area SDA3 and a fourth sub-display area SDA4.

The first sub-display area SDA1 and the third sub-display area SDA3 may be disposed adjacent to the first display area DA1, the second sub-display area SDA2 may be disposed apart from the first display area DA1 with the first sub-display area SDA1 in-between, and the fourth sub-display area SDA4 may be disposed apart from the first display area DA1 with the third sub-display area SDA3 in-between.

The second pixel PX2 may be classified into a second pixel PX2*a* disposed in the first sub-display area SDA1 and a second pixel PX2*b* disposed in the second sub-display area SDA2, and the third pixel PX3 may be classified into a third pixel PX3*a* disposed in the third sub-display area SDA3 and a third pixel PX3*b* disposed in the fourth sub-display area SDA4.

The signal lines may include scan lines SL1, SL2 and SL3, a data line DL, a power supply line PL, a first control line GSL1 and a second control line GSL2.

The scan lines SL1, SL2 and SL3 include first to third scan lines SL1-SL3. The first scan line SL1 may be disposed in the first display area DA1, the second scan line SL2 may disposed in the first sub-display area SDA1 of the second display area DA2 and in the third sub-display area SDA3 of the third display area DA3, and the third scan line SL3 may disposed in the second sub-display area SDA2 of the second display area DA2 and in the fourth sub-display area SDA4 of the third display area DA3. The first and second scan lines SL1 and SL2 may have a length longer than the length of the third scan line SL3.

The first to third scan lines SL1-SL3, the data line DL, and the power supply line PL are connected to the pixel PX. The data line DL and the power supply line PL may be connected to the driving circuit chip DIC to receive a driving signal.

The scan driving circuits GDC1 and GDC2 may include a first scan driving circuit GDC1 and a second scan driving circuit GDC2. The first and second scan driving circuit GDC1 and GDC2 may be disposed in the non-display area NDA. The first and second scan driving circuits GDC1 and GDC2 may generate scan signals and output the generated scan signals to the first to third scan lines SL1-SL3.

The first and second scan driving circuits GDC1 and GDC2 are connected to both opposite ends of the first scan line SL1 and the second scan line SL2. The first and second scan driving circuits GDC1 and GDC2 may apply scan signals at both opposite ends in order to prevent a charging failure caused by the delay of the scan signals applied to the first and second scan lines SL1 and SL2.

The third scan line SL3 disposed in the second sub-display area SDA2 may be connected to the first scan driving circuit GDC1, and the third scan line SL3 disposed in the fourth sub-display area SDA4 may be connected to the second scan driving circuit GDC2.

In an exemplary embodiment, the first and second scan driving circuits GDC1 and GDC2 may include a plurality of thin film transistors provided through the same process as the driving circuit of the pixels PX, for example, a low temperature polycrystalline silicon ("LTPS") process or a low temperature polycrystalline oxide ("LTPO") process.

The driving circuit chip DIC may be disposed in the non-display area NDA. The driving circuit chip DIC may be disposed (e.g., mounted) directly on the non-display area NDA, but the invention is not limited thereto. The driving circuit chip DIC may be disposed (e.g., mounted) on a flexible printed circuit board (not illustrated) connected through pads provided in the non-display area NDA. The driving circuit chip DIC provides a signal necessary for driving the display panel DP. That is, the driving circuit chip DIC may provide the signal to the data line DL and the power supply line PL. The driving circuit chip DIC may be a source driver integrated circuit which provides a data signal to the data line DL.

The driving circuit chip DIC may include a voltage generating circuit. However, this is an example, and the voltage generating circuit may be provided in a separate printed circuit board. The voltage generating circuit may generate driving voltages in response to a clock control signal and a vertical start signal, and may generate clock signals based on the driving voltages. The clock signals may be a wave-shaped signal having a gate-on voltage level and a gate-off voltage level. The clock signals may be output to the first and second scan driving circuits GDC1 and GDC2 through the first and second control lines GSL1 and GSL2.

The compensation electrodes MC1, MC2, and MC3 may be disposed in the non-display area NDA. The compensation electrodes MC1, MC2 and MC3 may be provided in plural. In an exemplary embodiment, the compensation electrode MC1, MC2 and MC3 may include a first compensation electrode MC1, a second compensation electrode MC2, and a third compensation electrode MC3, for example. However, this is an example, and the number of compensation electrodes may be one or three or more, and may be changed in variety.

The first compensation electrode MC1 may be disposed in the non-display area NDA adjacent to the second display area DA2, the second compensation electrode MC2 may be disposed in the non-display area NDA adjacent to the third display area DA3, and the third compensation electrode MC3 may be adjacent to the first display area DA1 and may be disposed in the non-display area NDA between the second display area DA2 and the third display area DA3.

The compensation wirings ML1, ML2 and ML3 may be provided in plural. In an exemplary embodiment, the compensation wirings ML1, ML2 and ML3 may include a first compensation wiring ML1, a second compensation wiring ML2, and a third compensation wiring ML3, for example.

The first compensation wiring ML1 is electrically connected to the second pixel PX2*b* disposed in the second sub-display area SDA2 among the second display area DA2, and may extend to the non-display area NDA and overlap the first compensation electrode MC1 in a plan view. The second compensation wiring ML2 is electrically connected to the third pixel PX3*b* disposed in the fourth sub-display area SDA4 among the third display area DA3, and may extend to the non-display area NDA and overlap the second compensation electrode MC2 in a plan view. The third compensation wiring ML3 is electrically connected to the second pixel PX2*a* disposed in the first sub-display area SDA1 among the second display area DA2 and the third pixel PX3*a* disposed in the fourth sub-display area SDA4 among the third display area DA3, and may extend to the non-display area NDA and overlap the third compensation electrode MC3 in a plan view.

The compensation wirings ML1, ML2 and ML3 may be electrically connected with the second and third scan lines SL2 and SL3. The second and third scan lines SL2 and SL3 and the compensation wirings ML1, ML2 and ML3 may be disposed on different layers from each other. Thus, the second and third scan lines SL2 and SL3 and the compensation wirings ML1, ML2 and ML3 may be electrically connected through a connection pattern BR.

The number of first pixels PX1 arranged in the first display area DA1 in the second direction DR2 and the number of second pixels PX2 arranged in the second display area DA2 in the second direction DR2 are different from each other, and thus the sum of the RC values in one row may be different in the first display area DA1 and the second display area DA2. For compensating for the RC value, the compensation wiring is electrically connected to the pixels disposed in the second and third display areas DA2 and DA3, and the compensation wiring extends so as to overlap the compensation electrode. Thus, the RC value insufficient compared to the first display area DA1 may be compensated by the capacitance and the resistance generated between the compensation wiring and the compensation electrode. Therefore, the difference between the response speed in each of the second display area DA2 and the third display area DA3 and the response speed in the first display area DA1 may be reduced, so that an image having uniform luminance may be displayed.

The first to third compensation electrodes MC1, MC2 and MC3 may receive a reference voltage from the outside. The reference voltage may be a gate-on voltage or a gat-off voltage. That is, the first to third compensation electrodes MC1, MC2 and MC3 may receive the signals supplied to the first and second scan driving circuits GDC1 and GDC2.

The first compensation electrode MC1 may receive the reference voltage through a first line MCL1 connected with the first scan driving circuit GDC1. However, this is an example, and the first compensation electrode MC1 may directly receive the reference voltage from the voltage generating circuit of the driving circuit chip DIC. In this case, a separate pad (not illustrated) which provides the reference voltage to the first compensation electrode MC1 may be further included. The second compensation electrode MC2 may receive the reference voltage through a second line MCL2 connected with the second scan driving circuit GDC2, and the third compensation electrode MC3 may receive the reference voltage through a third line MCL3 connected with the first compensation electrode MC1 and a fourth line MCL4 connected with the second compensation electrode MC2.

According to an exemplary embodiment of the invention, the first to third compensation electrodes MC1, MC2 and MC3 are not connected with wirings disposed inside the display area DA. Thus, even when the static electricity is generated in the first and third compensation electrodes MC1, MC2 and MC3, the limitation that the static electricity is delivered to the display area DA through wirings disposed inside the display area DA may be blocked. Therefore, the reliability of the display device DD (refer to FIG. 1) may be improved.

Figure 4:
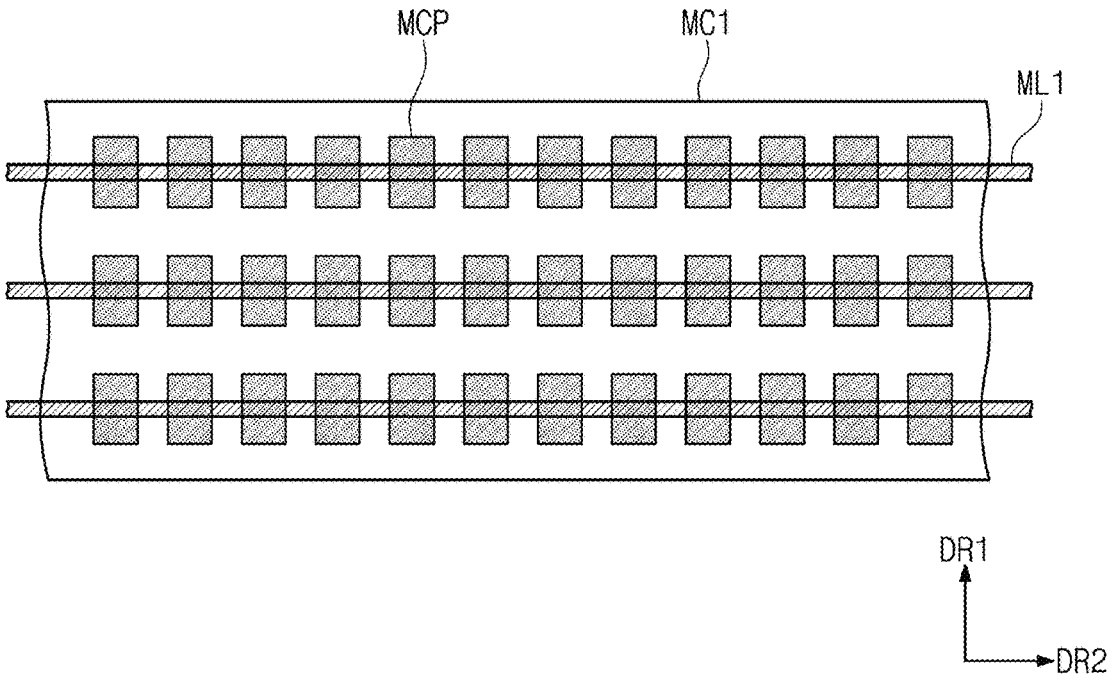
FIG. 4 is a plan view illustrating an exemplary embodiment of a portion of the configuration of a display panel, according to the invention.

FIG. 4 is a plan view illustrating a portion of the configuration of a display panel, according to an exemplary embodiment of the invention. Specifically, FIG. 4 is an enlarged plan view illustrating one area in which the first compensation electrode MC1 is disposed.

Referring to FIG. 4, the first compensation wiring ML1 may be disposed under the first compensation electrode MC1, and the compensation patterns MCP may be disposed under the first compensation wiring ML1. The first compensation wiring ML1 may overlap the first compensation electrode MC1 and the compensation patterns MCP in a plan view.

When the first compensation wiring ML1 overlapping the first compensation electrode MC1 extends along the second direction DR2, the compensation patterns MCP may be disposed apart from each other in the second direction DR2 which is the same as the direction to which the first compensation wiring ML1 extends.

Figure 5:
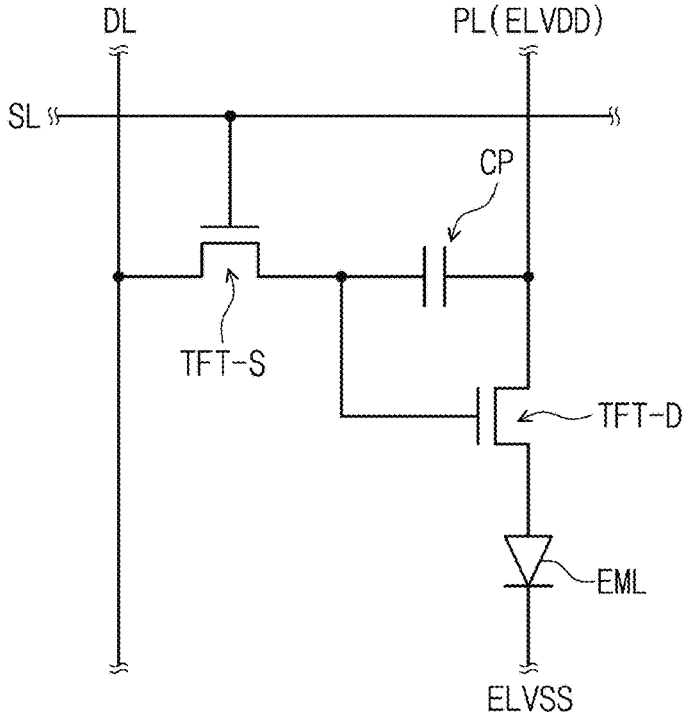
FIG. 5 is an equivalent circuit diagram of an exemplary embodiment of a pixel according to the invention.

FIG. 5 is an equivalent circuit diagram of a pixel according to an exemplary embodiment of the invention.

Referring to FIG. 5, the equivalent diagram of a pixel PX (refer to FIG. 2) connected to one scan line SL, one data line DL, and a power supply line PL is exemplarily illustrated. However, this is an example, and the circuit of the pixel PX is variously changed.

The pixel PX may include a switching transistor TFT-S, a driving transistor TFT-D, a capacitor CP and a light emitting device EML.

The switching transistor TFT-S outputs a data signal applied to the data line DL in response to a scan signal applied the scan line SL. The capacitor CP charges the voltage corresponding to the data signal received from the switching transistor TFT-S.

The driving transistor TFT-D corresponds to the amount of charge stored in the capacitor CP, and thus controls the driving current flowing in the light emitting device EML. The control electrode of the driving transistor TFT-D may be connected between the switching transistor TFT-S and the capacitor CP.

The light emitting device EML may be an organic light emitting diode. In an exemplary embodiment, the light emitting device EML may be a front light emitting diode or a rear light emitting diode, for example. In an alternative exemplary embodiment, the light emitting device EML may be a double-sided light emitting diode, for example.

In the pixel PX, a first power supply voltage ELVDD and a second power supply voltage ELVSS may be applied. The first power supply voltage ELVDD may be applied to the pixel PX through the power supply line PL, and the second power supply voltage ELVSS may be applied to the pixel PX through a power supply electrode (not illustrated). The voltage level of the first power supply voltage ELVDD may be higher than the voltage level of the second power supply voltage ELVSS.

The first to third compensation electrodes MC1, MC2 and MC3 described previously in FIGS. 3 and 4 may receive a reference voltage from the outside. The reference voltage may be a gate-on voltage or a gate-off voltage. That is, the reference voltage may be a different voltage from the first power supply voltage ELVDD and the second power supply voltage ELVSS.

Figure 6:
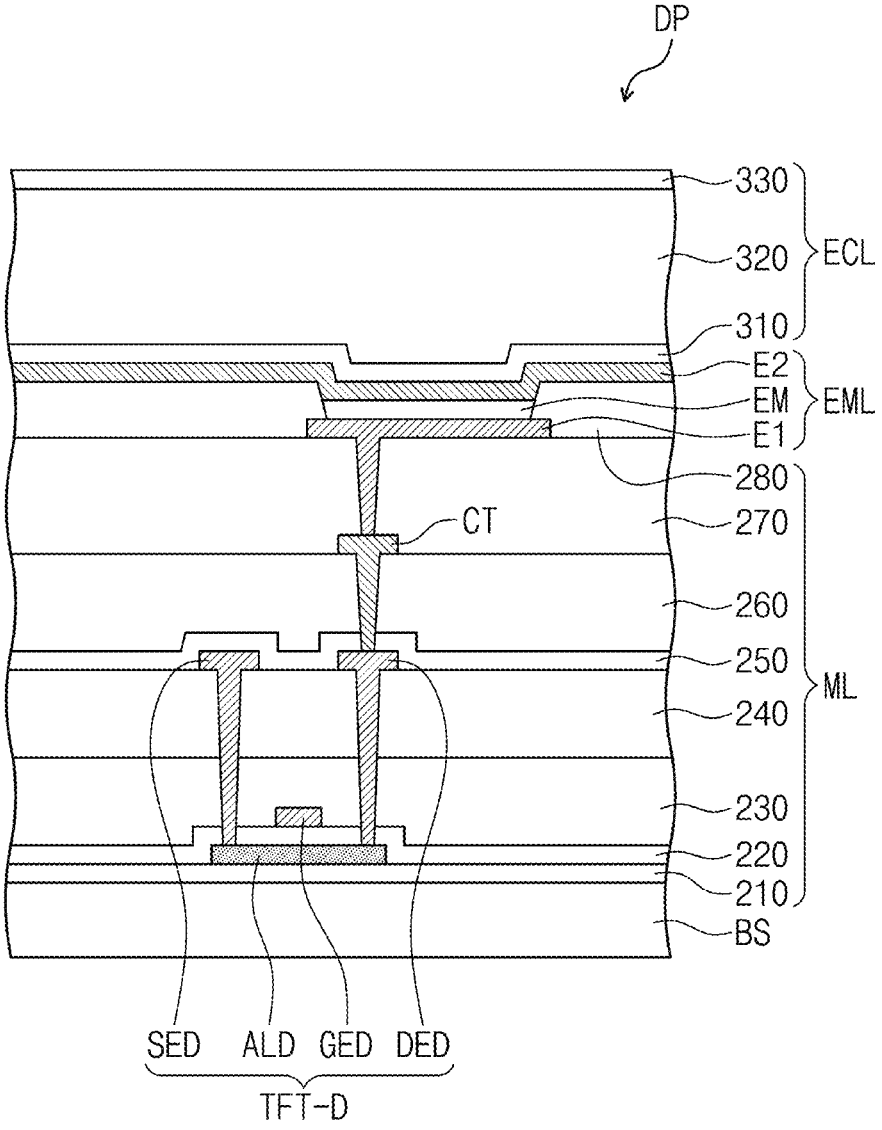
FIG. 6 is a cross-sectional view of an exemplary embodiment of a pixel according to the invention.
Figure 7:
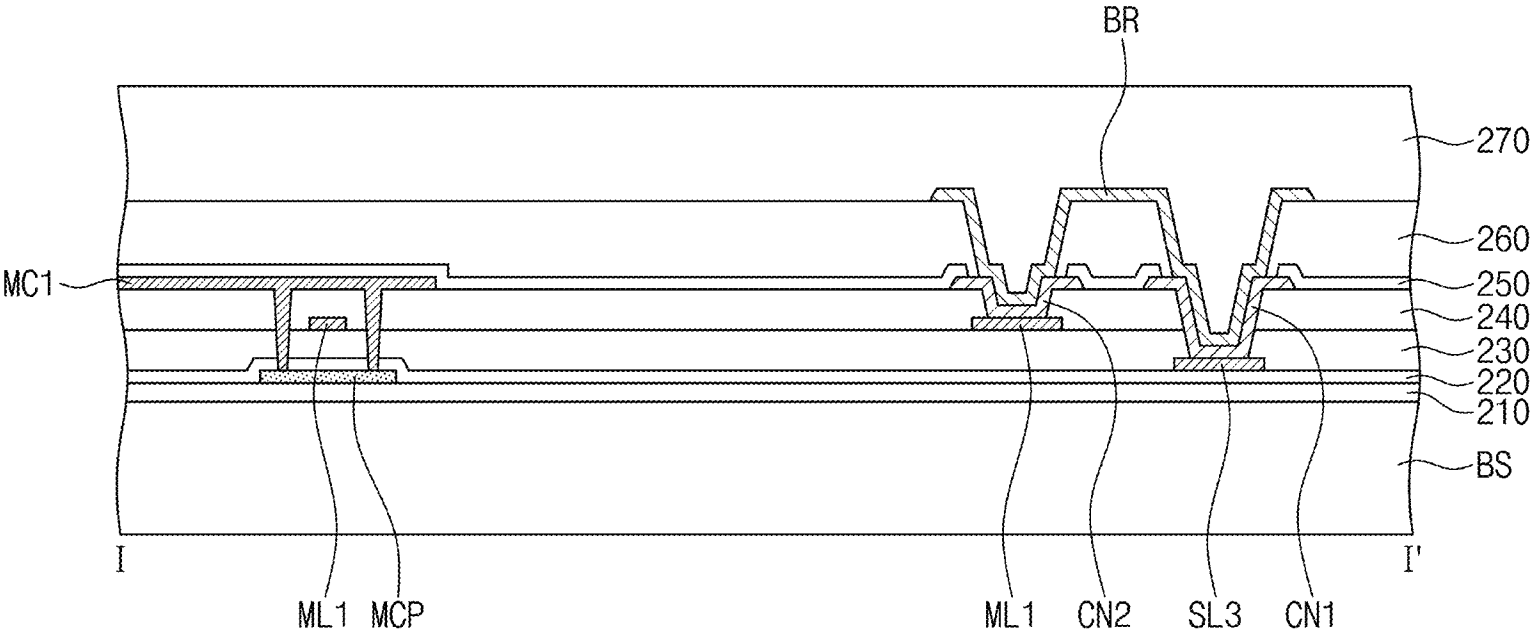
FIG. 7 is a cross-sectional view taken along line I-I' illustrated in FIG. 3; and, FIG. 8 is an enlarged plan view a portion of a display panel, according to an exemplary embodiment of the invention.

FIG. 6 is a view illustrating a cross-sectional view of a pixel according to an exemplary embodiment of the invention, and FIG. 7 is a cross-sectional view taken along line I-I' illustrated in FIG. 3.

Referring to FIGS. 6 and 7, the display panel DP may include a base layer BS, a circuit layer ML, a light emitting layer EML, and a thin film encapsulation layer ECL.

A first insulation layer 210 is disposed on the base layer BS, and a driving transistor TFT-D may be disposed on the first insulation layer 210. The driving transistor TFT-D may include a semiconductor pattern ALD, a control electrode GED, a first electrode SED and a second electrode DED.

The semiconductor pattern ALD and the compensation patterns MCP may be disposed on the first insulation layer 210. The semiconductor pattern ALD and the compensation pattern MCP may be disposed in the same layer, and may be provided through the same process. Thus, the semiconductor pattern ALD and the compensation pattern MCP may be include the same material as each other.

The first insulation layer 210 may be a buffer layer providing the modified surface to the semiconductor pattern ALD and the compensation patterns MCP. In this case, the semiconductor pattern ALD and the compensation patterns MCP may have an adhesive force higher than that in the case of being directly disposed on the base layer BS, with respect to the first insulation layer 210. In an alternative exemplary embodiment, the first insulation layer 210 may be a barrier layer which protects the lower surface of the semiconductor pattern ALD and the compensation patterns MCP. In this case, the first insulation layer 210 may block contaminants or humidity generated by the base layer BS itself or entering through the base layer BS from permeating into the semiconductor pattern ALD and the compensation patterns MCP. In an alternative exemplary embodiment, the first insulation layer 210 may be a light blocking layer which blocks the external light incident through the base layer BS from being incident into the semiconductor pattern ALD and the compensation patterns MCP. In this case, the first insulation layer 210 may further include a light blocking material.

A second insulation layer 220 may be disposed on the first insulation layer 210, and may cover the semiconductor pattern ALD and the compensation patterns MCP. The second insulation layer 220 may include an inorganic material and/or an organic material. The control electrode GED may be disposed on the second insulation layer 220.

A third insulation layer 230 may be disposed on the second insulation layer 220, and may cover the control electrode GED. The third insulation layer 230 may include an inorganic and/or an organic material.

The first compensation wiring ML1 may be disposed on the third insulation layer 230. The first compensation wiring ML1 may be electrically connected with the third scan line SL3 by the connection pattern BR. This will be described later.

A fourth insulation layer 240 may be disposed on the first compensation wiring ML1, and may cover the first compensation wiring ML1. The fourth insulation layer 240 may include an inorganic material and/or an organic material.

The first electrode SED, the second electrode DED, and the first compensation electrode MC1 may be disposed on the fourth insulation layer 240. Each of the first electrode SED and the second electrode DED may penetrate the second insulation layer 220, the third insulation layer 230, and the fourth insulation layer 240 to be connected to the semiconductor pattern ALD.

The first compensation electrode MC1 may penetrate the second insulation layer 220, the third insulation layer 230, and the fourth insulation layer 240 to contact the compensation patterns MCP. Thus, the same voltage as that of the first compensation electrode MC1 may be supplied to the compensation patterns MCP, and a capacitor may be generated between the first compensation wiring ML1 and the first compensation electrode MC1 and between the first compensation wiring ML1 and the compensation patterns MCP. As the capacitor is generated in double by the compensation patterns MCP, the area of the first compensation electrode MC1 in a plan view may be reduced. However, the compensation patterns MCP may not be provided in another exemplary embodiment of the invention.

A first connection pattern CN1 and a second connection pattern CN2 may be further disposed on the fourth insulation layer 240. The first connection pattern CN1 and the second connection pattern CN2 may be disposed in the same layer as the first electrode SED and the second electrode DED, and may be provided through the same process at the same time.

The first connection pattern CN1 may contact the end portion of the third scan line SL3 exposed through the openings defined in the third insulation layer 230 and the fourth insulation layer 240, and the second connection pattern CN2 may contact the first compensation wiring ML1 exposed through the openings defined in the fourth insulation layer 240. However, this is an example, and the first and second connection patterns CN1 and CN2 may not be provided in another exemplary embodiment of the invention.

A fifth insulation layer 250 is disposed on the fourth insulation layer 240, and may cover the first and second electrodes SED and DED and the first and second connection patterns CN1 and CN2. The fifth insulation layer 250 may be a passivation layer, and may include an inorganic material. That is, the fifth insulation layer 250 may be provided by depositing an inorganic material.

A sixth insulation layer 260 is disposed on the fifth insulation layer 250. The sixth insulation layer 260 may have a laminated structure including an organic film, or an organic film and an inorganic film. The sixth insulation layer 260 may be a planarization layer providing a flat surface on the upper portion thereof. A third electrode CT and the connection pattern BR may be disposed on the sixth insulation layer 260, and may be provided through the same process at the same time.

The third electrode CT may penetrate the fifth and sixth insulation layers 250 and 260 to be connected to the second electrode DED. The third electrode CT may include a material having a lower resistance than the first and second electrodes SED and DED. Accordingly, the contact resistance between the light emitting device layer EML and the driving transistor TFT-D may be reduced, so that the electrical characteristics may be improved.

The connection pattern BR may penetrate the fifth and sixth insulation layers 250 and 260 to be connected to the first and second connection patterns CN1 and CN2. Thus, the third scan line SL3 and the first compensation wiring ML1 may be electrically connected by the connection pattern BR. When the first connection pattern CN1 and the second connection pattern CN2 are not provided, the connection pattern BR may penetrate the third to sixth insulation layers 230, 240, 250 and 260 to be connected the third scan line SL3, and may penetrate the fourth to sixth insulation layers 240, 250 and 260 to be connected to the first compensation wiring ML1.

A seventh insulation layer 270 may be disposed on the sixth insulation layer 260, and may cover the third electrode CT and the connection pattern BR. The seventh insulation layer 270 may have a laminated structure including an organic film and an inorganic film. The seventh insulation layer 270 may be a planarization layer providing a flat surface on the upper portion thereof.

The light emitting device layer EML may be disposed on the seventh insulation layer 270. The light emitting device layer EML may include a first electrode E1, a light emitting layer EM, and a second electrode E2. The first electrode E1 may be disposed on the seventh insulation layer 270 and penetrate the seventh insulation layer 270 to be connected to the third electrode CT. The display panel DP according to an exemplary embodiment of the invention may further include the third electrode CT, so even when the first electrode E1 penetrates only single seventh insulation layer 270, the first electrode E1 may be electrically connected to the driving transistor TFT-D.

An eighth insulation layer 280 may be disposed on the seventh insulation layer 270. An opening portion may be defined in the eighth insulation layer 280, and a portion of the first electrode E1 may be exposed by the opening portion. The light emitting layer EM may be disposed on the exposed first electrode E1. The light emitting layer EM may include a light emitting material, and may be excited to generate the light when the electrical signal is applied. The eighth insulation layer 280 may be referred to a pixel definition film.

The second electrode E2 may be disposed on the light emitting layer EM and the eighth insulation layer 280. The second electrode E2 may receive the second power supply voltage ELVSS (refer to FIG. 5).

The thin film encapsulation layer ECL is disposed on the second electrode E2. The thin film encapsulation layer ECL may directly cover the second electrode E2. In another exemplary embodiment of the invention, a capping layer may be further disposed between the thin film encapsulation layer ECL and the second electrode E2 to cover the second electrode E2. In this case, the thin film encapsulation layer ECL may directly cover the capping layer.

The thin film encapsulation layer ECL may include a first inorganic layer 310, an organic layer 320, and a second inorganic layer 330, which are sequentially laminated. The organic layer 320 may be disposed on the first inorganic layer 310. The first and second inorganic layers 310 and 330 may be provided by depositing an inorganic material, and the organic layer 320 may be provided by depositing, printing, or coating an organic material.

FIG. 6 exemplarily illustrates, but is not limited to, that the thin film encapsulation layer ECL includes two inorganic layers and one organic layer. In another exemplary embodiment, the thin film encapsulation layer ECL may include three inorganic layers and two organic layers, for example. In this case, the inorganic layer and the organic layer may alternately have a laminated structure.

Figure 8:
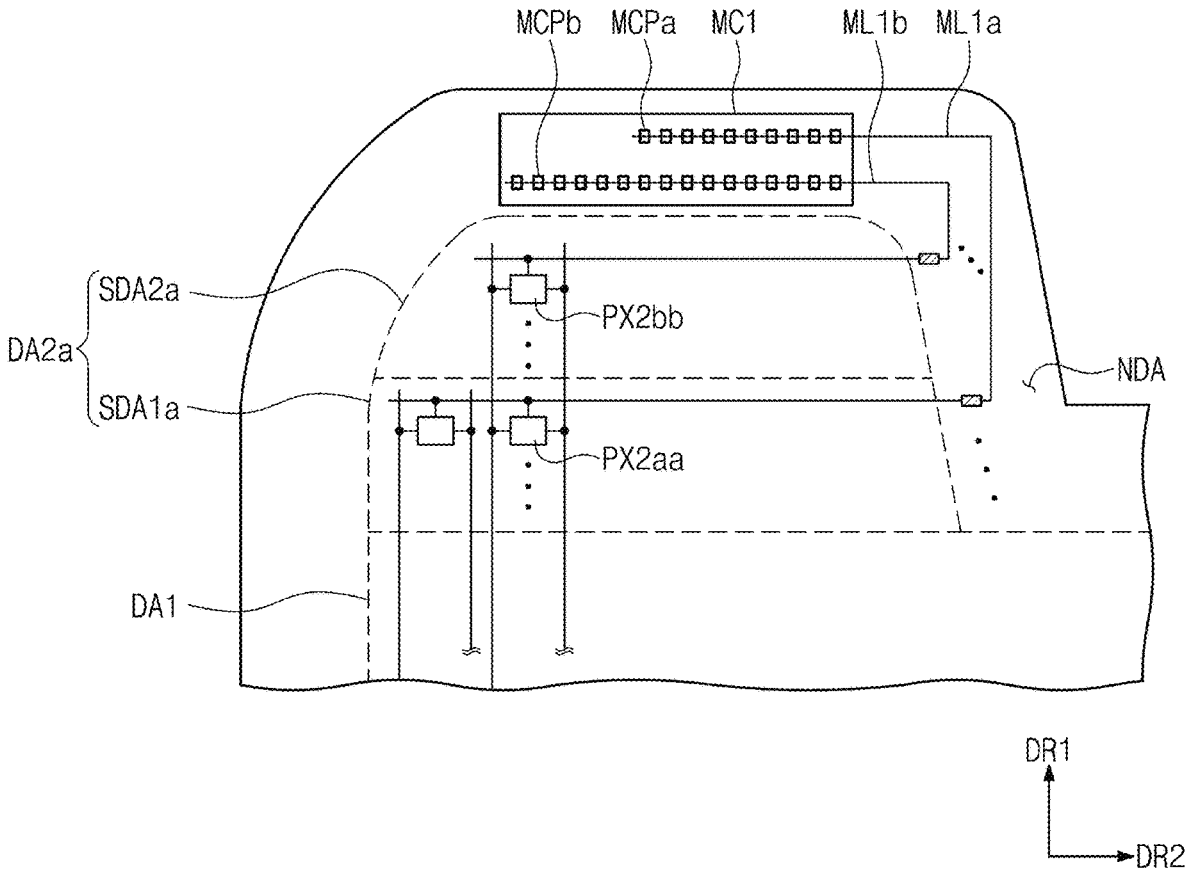

FIG. 8 is an enlarged plan view illustrating a portion of the display panel, according to an exemplary embodiment of the invention.

Referring to FIG. 8, a second display area DA2*a* protrudes from the first display area DA1 in the first direction DR1. The width of the second display area DA2*a* in the second direction DR2 may have a narrowed shape as being farther from the first display area DA1.

The second display area DA2*a* may include a first sub-display area SDA1*a* and a second sub-display area SDA2*a*. The first sub-display area SDA1*a* may be disposed adjacent to the first display area DA1, and the second sub-display area SDA2*a* may be disposed apart from the first display area DA1 with the first sub-display area SDA1*a* in-between.

In FIG. 8, the width of the second display area DA2*a* is not constant in the second direction DR2, and thus the number of pixels in one row arranged along the second direction DR2 may be varied depending on the area. In an exemplary embodiment, the number of second pixels PX2*aa* arranged in the first sub-display area SDA1*a* along the second direction DR2 may be larger than the number of second pixels PX2*bb* arranged in the second sub-display area SDA2*a* along the second direction DR2, for example. That is, the RC value insufficient compared to that of the first display rea DA1 may be different in the second display area DA2*a*.

In order to adjust the compensation value depending on each area, the number of compensation patterns MCPa and MCPb may be adjusted, or the length of compensation wirings ML1*a* and ML1*b* may be adjusted. FIG. 8 exemplarily illustrates, but is not limited to, that the number of compensation patterns MCPa and MCPb and the length of compensation wirings ML1*a* and ML1*b* are all adjusted. In an exemplary embodiment, only the length of the compensation wirings ML1*a* and ML1*b* may be adjusted, or only the number of compensation patterns MCPa and MCPb may also be adjusted, for example.

In an area overlapping the first compensation electrode MC1, the length of the compensation wiring ML1*a* connected to the second pixel PX2*aa* disposed in the first sub-display area SDA1*a* may be shorter than the length of the compensation wiring ML1*b* connected to the second pixel PX2*bb* disposed in the second sub-display area SDA2*a*. Also, the number of compensation patterns MCPa overlapping the compensation wirings ML1*a* may be smaller than the number of compensation patterns MCPb overlapping the compensation wiring ML2*a*.

According to an exemplary embodiment of the invention, a display area includes a first display area and a second display area partially protruding from the first display area. Pixels disposed in the second display area may have the same luminance as that of pixels disposed in the first display area by a compensation electrode. Accordingly, the display quality of the display device having an atypical display area may be improved. Further, the compensation electrode is not connected with wirings disposed inside the display area. Thus, even when the static electricity is generated in the compensation electrode, the limitation that the static electricity is transferred to the display area through wirings disposed inside the display area may be blocked. Therefore, the reliability of the display device may be improved.

Although the exemplary embodiments of the invention have been described, it is understood that the invention should not be limited to these exemplary embodiments but various changes and modifications may be made by one ordinary skilled in the art within the spirit and scope of the invention as hereinafter claimed.

What is claimed is:

1. A display device, comprising:

a base layer in which a display area and a non-display area adjacent to the display area are defined, the display area including a first display area and a second display area protruding from the first display area in a first direction;

a plurality of pixels disposed in the display area;

a scan driving circuit which is disposed in the non-display area, receives a reference voltage from an outside, and outputs a scan signal to the plurality of pixels;

a first compensation electrode which is disposed in the non-display area and receives the reference voltage;

a first compensation wiring electrically connected to pixels disposed in the second display area among the plurality of pixels, and extending to the non-display area to overlap the first compensation electrode in a plan view, and compensation patterns overlapping the first compensation electrode and the first compensation wiring in the plan view, wherein the first compensation wiring is disposed between the first compensation electrode and the compensation patterns in a cross section.

2. The display device of claim 1, wherein a width of the first display area in a second direction crossing the first direction is larger than a maximum width of the second display area in the second direction.

3. The display device of claim 1, further comprising a third display area protruding from the first display area in the first direction and spaced apart from the second display area in a second direction crossing the first direction.

4. The display device of claim 3, further comprising:

a second compensation electrode which is disposed in the non-display area and receives the reference voltage; and a second compensation wiring electrically connected to pixels disposed in the third display area among the plurality of pixels, and extending to the non-display area and overlapping the second compensation electrode in the plan view.

5. The display device of claim 3, wherein the second display area comprises a first sub-display area adjacent to the first display area and a second sub-display area spaced apart from the first display area with the first sub-display area in-between, and the third display area comprises a third sub-display area adjacent to the first display area and a fourth sub-display area spaced apart from the first display area with the third sub-display area in-between, the display device further including a second compensation electrode which receives the reference voltage in the non-display area disposed between the first sub-display area and the third sub-display area in the plan view.

6. The display device of claim 5, further including a second compensation wiring electrically connected to pixels disposed in the first sub-display area and the third sub-display area, and extending to the non-display area and overlapping the second compensation electrode in the plan view.

7. The display device of claim 1, wherein the compensation patterns are electrically connected with the first compensation electrode and receive the reference voltage.

8. The display device of claim 1, wherein when the first compensation wiring overlapping the first compensation electrode extends along a predetermined direction, the compensation patterns are disposed apart from each other in the same direction as the direction to which the first compensation wiring extends.

9. The display device of claim 1, wherein the pixels comprise a thin film transistor including a semiconductor pattern and a light emitting device connected to the thin film transistor, and the compensation patterns comprise the same material as that of the semiconductor pattern.

10. The display device of claim 1, wherein a width of the second display area in a second direction crossing the first direction has a narrowed shape as being farther from the first display area, and the second display area comprises a first sub-display area adjacent to the first display area and a second sub-display area spaced apart from the first display area with the first display area in-between.

11. The display device of claim 10, wherein a first number of compensation patterns overlapping a compensation wiring electrically connected to pixels disposed in the first sub-display area among the plurality of pixels is smaller than a second number of compensation patterns overlapping a compensation wiring electrically connected to pixels disposed in the second sub-display area among the plurality of pixels.

12. A display device comprising:

a base layer in which a display area and a non-display area are defined;

a first pixel group and a second pixel group disposed in the display area, and arranged along a first direction;

a compensation electrode which is disposed in the non-display area, and receives a gate-on voltage or a gate-off voltage from an outside;

a compensation wiring electrically connected with pixels of the second pixel group, and extending to the non-display area and overlapping the compensation electrode in a plan view;

compensation patterns overlapping the compensation electrode and the compensation wiring in the plan view;

wherein the compensation wiring is disposed between the compensation electrode and the compensation patterns in a cross section, and wherein the first pixel group comprises first pixels arranged in a second direction crossing the first direction and the second pixel group comprises second pixels arranged in the second direction, and a first number of second pixels is smaller than a second number of first pixels.

13. The display device of claim 12, wherein the display area comprises a first display area and a second display area protruding from the first display area in the first direction, and the first pixel group is disposed in the first display area and the second pixel group is disposed in the second display area.

14. The display device of claim 13, wherein a width of the first display area in the second direction is larger than a width of the second display area in the second direction.

15. The display device of claim 12, wherein the first pixel group and the second pixel group receive a first power supply voltage and a second power supply voltage from the outside.

16. The display device of claim 12, further including a scan driving circuit which is disposed in the non-display area, receives the gate-on voltage and the gate-off voltage, and outputs a scan signal to the first and second pixel groups.

17. A display device comprising:

a base layer in which a display area and a non-display area adjacent to the display area are defined, the display area including a first display area and a second display area protruding from the first display area in a first direction;

a plurality of pixels which is disposed in the display area, and receives a first power supply voltage and a second power supply voltage from an outside;

a compensation electrode which is disposed in the non-display area, and receives a reference voltage different from the first power supply voltage and the second power supply voltage; and a compensation wiring electrically connected to pixels disposed in the second display area among the plurality of pixels, and extending to the non-display area and overlapping the compensation electrode; and compensation patterns overlapping the compensation electrode and the compensation wiring in a plan view, wherein the compensation wiring is disposed between the compensation electrode and the compensation patterns in a cross section.

18. The display device of claim 17, wherein a first number of pixels in one row arranged in a second direction crossing the first direction in the first display area is larger than a second number of pixels in one row arranged in the second direction in the second display area.

19. The display device of claim 17, further comprising a scan driving circuit which is disposed in the non-display area, receives the reference voltage, and outputs a scan signal to the plurality of pixels.

* * * * *